United States Patent [19]

Carter

[11] Patent Number: 4,570,164

[45] Date of Patent: Feb. 11, 1986

[54] RECEIVE ANTENNA SYSTEM IN THE PRESENCE OF A TRANSMITTING ANTENNA

[75] Inventor: Robert C. Carter, Richardson, Tex.

[73] Assignee: Rockwell International Corporation, El Segundo, Calif.

[21] Appl. No.: 414,210

[22] Filed: Sep. 2, 1982

[51] Int. Cl.[4] ..... H01Q 1/28

[52] U.S. Cl. ..... 343/706; 343/728; 343/855

[58] Field of Search ..... 343/706, 890, 891, 725, 343/726, 727, 728, 729, 730, 844, 893, 742, 855, 867

[56] References Cited

U.S. PATENT DOCUMENTS 2,421,032 5/1947 Marchand ..... 343/726

*Primary Examiner*—Eli Lieberman
*Assistant Examiner*—K. Ohralik
*Attorney, Agent, or Firm*—Richard A. Bachand; V. Lawrence Sewell; H. Fredrick Hamann

[57] ABSTRACT

A receiving antenna for use in proximity to an antenna having a circular radiating magnetic field includes at least one antenna having a null spatial sensitivity pattern along at least one axis, oriented with the circular radiating antenna located in said null pattern. In a preferred embodiment, the antenna having spatial sensitivity is three orthogonally oriented loop antennas, arranged to be insensitive to signals from the circular radiating antenna and sensitive to TE and TM signals from a remote location.

14 Claims, 2 Drawing Figures

RECEIVE ANTENNA SYSTEM IN THE PRESENCE OF A TRANSMITTING ANTENNA

BACKGROUND OF THE INVENTION

1. FIELD OF THE INVENTION

This invention relates to improvements in systems and techniques for radio transmitting and receiving and to antenna systems for use is such radio systems, and, more particularly, to improvements in radio receiver antennas adapted for use in full duplex operation in proximity to a transmitter antenna.

2. BRIEF DESCRIPTION OF THE PRIOR ART

In many instances it is desirable to operate both a radio transmitter and receiver simultaneously, such operation being referred to herein as full duplex operation. Although such operation in the case of a receiver which happens to be located adjacent a transmitter antenna may be fortuitous, such operations are often times intended. One such instance in which such duplex operation may be desirable, for example, is in balloon-borne very low frequency (VLF) relay systems and the like. Typically, the transmitter and receiver in such systems operate near the same frequency, and in VLF systems, usually the transmitter and receiver utilize the same antenna. Because of the wave lengths involved in VLF operations, long wire or monopole vertical antennas are usually used, suspended, for instance, from a balloon or the like.

In the past, in order to enable the same antenna to be used for both transmitting and receiving, in some cases a notch filter was used to reduce the magnitude of the transmitter output at the receiver to enable the receiver to operate without its input being saturated. Notch filters typically employed, however, are difficult to design because they require a very high Q. (Notch filters typically employed often have insertion losses greater than 60dB at the transmitter center frequency whereas they may typically have 0 to 6dB loss at the adjacent receiver frequency.) This requirement is compounded if the transmitter is designed to operate over a band of frequencies, thus requiring the notch filter to be tuneable, or at least switchable, amongst various frequencies offset from the transmitter frequency.

Typically, a transmitter may be centrally located along the length of a long wire antenna, which may be several thousand feet in length, and which may be suspended from a balloon. The receiver derives its input from the long wire transmitter antenna by a current transformer, which may, for example, be an iron core ring surrounding the long wire and having multiple turns around the ring from which the output signal is derived for application to the aforementioned notch filter.

In light of the above, it is, therefore, an object of the invention to provide an antenna configuration which is essentially insensitive to magnetic fields generated in a long wire antenna by an associated transmitter, yet is sensitive to receive both TE and TM fields from distant transmissions.

It is another object of the invention to provide an antenna configuration of the type described for use in VLF applications.

It is yet another object of the invention to provide an antenna configuration of the type described for use in balloon-borne systems.

These and other objects, features and advantages will become apparent to those having ordinary skill in the art from the following detailed description when read in conjunction with the accompanying drawings and appended claims.

The invention in its broad aspect, presents an antenna system including a receiving antenna for use in proximity to a transmitting antenna having a circular radiating magnetic field. At least one receiving antenna has a null spatial sensitivity pattern along at least one axis, oriented with the transmitting antenna located in said null pattern. Thus, the at least one antenna is insensitive to signals from said transmitting antenna and is sensitive to signals from a remote location. In one embodiment, the receiving antenna includes at least one loop which is oriented with an imaginary line piercing a central point of the loop being perpendicular to a plane containing the loop. The line is disposed to intersect a monopole transmitter antenna, resulting in the monopole antenna being located in a null region of sensitivity of the loop antenna.

BRIEF DESCRIPTION OF THE DRAWING

The invention is illustrated in the accompanying drawing in which.

In the Figures of the drawing, the sizes and dimensions of the various parts have been exaggerated or distorted for clarity of illustration and ease of description. In addition, like reference numerals are used to denote like or similar parts.

DETAILED DESCRIPTION OF THE PREFERRED EMBODIMENTS

Figure 1:
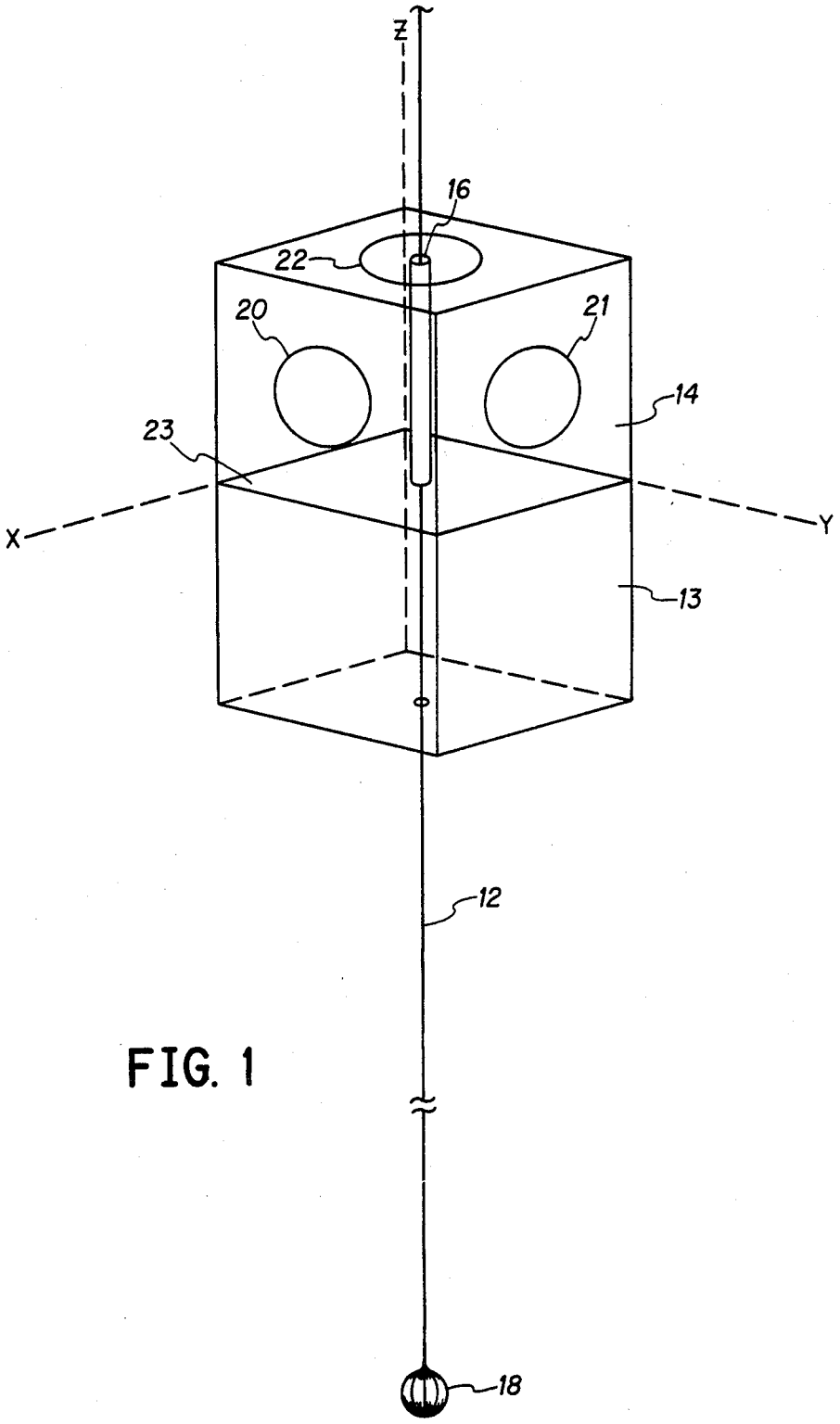
FIG. 1 is a diagrammatic view of a transmitter and receiver combination for use in a very low frequency full duplex system, illustrating a preferred embodiment of the antenna configuration in accordance with the invention.

A preferred embodiment of the invention is shown in FIG. 1, a diagrammatic view showing transmitter, receiver and antenna portions of a very low frequency (VLF) system. It should be noted that although the invention is described herein with particular reference to VLF radio systems, it is not intended that the invention and its application be limited to such VLF systems; the principles applicable to the design and operation of the invention can be equally advantageously employed in any radio communication system presenting the antenna configuration and signal requirements described hereinbelow.

As shown in FIG. 1, the invention is used in conjunction with a single transmitting antenna 12. The transmitting antenna 12 can be any kind having a known magnetic field radiation pattern which can be oriented within a region of null sensitivity of an associated receiving antenna, as will become apparent below. In a preferred embodiment, the transmitting antenna is of a type which radiates a circular magnetic field, and may be, for example, a long wire or monopole type transmitting antenna, as shown. As shown, the long wire transmitter antenna 12 is weighted by a weight 18 at one end and is supported vertically by a balloon or other suitable means (not shown) at its other end.

In the embodiment shown, the transmitter (not shown) is contained in a compartment 13 carried on the transmitter antenna 12. A suitable receiver (not shown) is contained in a receiver compartment 14, also carried on the antenna 12 adjacent the transmitter compartment 13. The position of the transmitter antenna 12 through the receiver compartment 14 is maintained by a wire feed-through tube 16.

For convenience, an imaginary axis, labeled X, Y, and Z is superimposed on the drawing for convenient reference with respect to the various parts of the antenna system of the invention.

At least one, and preferrably three, receiver antennas are provided. The receiver antennas each have at least one spatial region of null sensitivity and are oriented with respect to the transmitter antenna such that the magnetic fields radiated by the transmitter antenna fall upon the receiving antenna in such null sensitivity region. In a preferred embodiment, the receiver antennas used are loops, since loop antennas have a "figure 8" sensitivity pattern, as is known in the art. Thus, three receiver antenna loops 20, 21, and 22 are carried on the receiver compartment 14, in accordance with the invention, and are connected to the receiver (not shown) within the receiver compartment 14. It should be noted that other forms of loop antennas, such as commonly known ferrite stick type of receiver antenna can be used in the realization of the advantages of the invention, as well become apparent.

Figure 2:
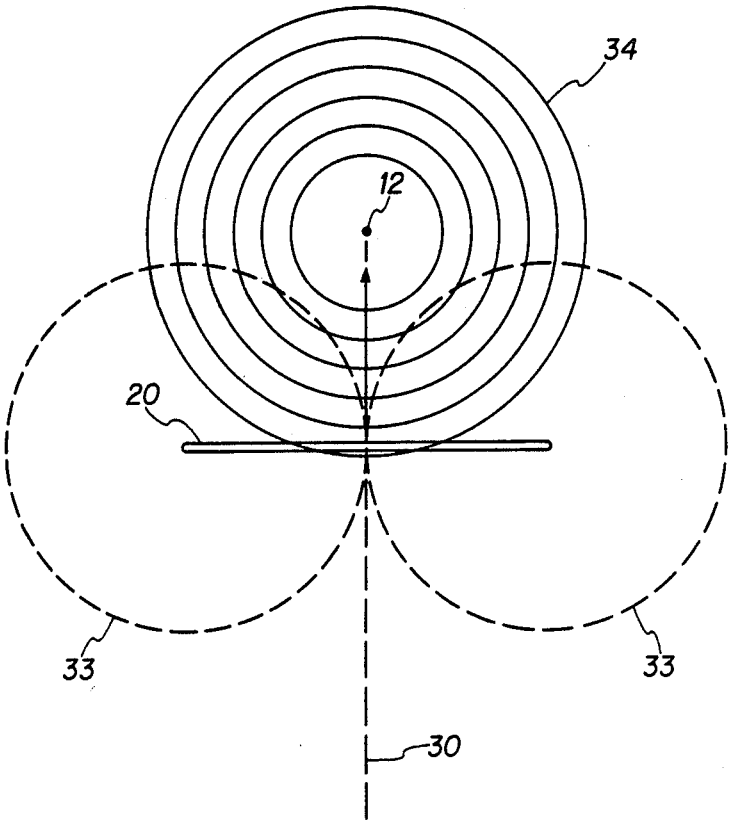
FIG. 2 is a plan view of an antenna configuration, in accordance with the principles of the invention.

The receiver antennas 20–22 are aligned with respect to the transmitter antenna 12 as follows, with reference now to FIG. 2. As shown, the receiver loop antenna 20 is located adjacent the transmitter antenna 12 with an imaginary line 30 piercing the center of the loop 20 and oriented perpendicularly to the plane of the loop, arranged to intersect the transmitter antenna 12. It can be seen from an examination of the loop antenna sensitivity pattern, shown by the dotted lines 33, that if the imaginary line 30 lies in the plane defined by the transmitter antenna 12, the antenna 12 is a region of null sensitivity of the receiver antenna 20, no voltage is induced in the loop due to the transmitter antenna current and its resulting magnetic field 34. Thus, even if the loop 20 is adjacent the transmitter antenna, the loop 20 is insensitive to the signal in the transmitter antenna 12. It should be noted that the imaginary line 30 need not necessarily intersect the transmitter antenna 12 at right angles, the primary aim being merely that it intersect in a manner whereby the sensitivity patterns of the receiver antenna 20 are insensitive to the signals in the transmitter antenna 12. Thus, the loop 20 may be tilted (maintaining the intersection of the imaginary line 30 to the transmitter antenna 12) even until the plane of the loop is perpendicular to the line defined by the transmitter antenna 12.

With respect now again to FIG. 1, the other antennas 21 and 22 are arranged in a similar fashion with respect to the transmitting antenna 12; that is, with a line piercing the center of the loop and perpendicular to the loop passing the line formed by the transmitting antenna 12.

In the case of a VLF transmitter and receiver system as shown in FIG. 1, it can be seen that the horizontal orientation of the receiver antenna loop 22 is ideal for receiving "TE" signals originated at a distant location (not shown). This is true even though the transmitter antenna threads the loop 22; that is, the imaginary line along the Z axis lies along the length of the transmitter antenna 12.

The particular orientation of the receiver loops 20 and 21 with their respective imaginary lines being parallel to the X and Y axes are ideally suited for reception of "TM" signals generated from a remotely located source (not shown). Because of the particular sensitivity patterns of the various receiver loops, the distance of the TM loops 20 and 21 to the transmitter wire 12 is arbitrary, except the closer the spacing, the more critical the dimensional tolerance required to maintain a given null supression.

With respect to the TE loop 22, the receiver loop 22 can be raised or lowered without affecting the depth of the null to the transmitted signal; however, its sensitivity to distant TE fields decreases as its distance to the top of the transmitter compartment 23, is decreased. This is so since the metal top of the transmitter compartment acts essentially as a shorted turn on the TE loop, and the closer the antenna 22 is brought to the metal compartment top 23, the tighter the coupling, and, therefore, the lower the sensitivity of the antenna 22. (It should be noted that the compartment 14 containing the receiver is formed of a non-metallic or non-conducting material.)

With the antenna system constructed as shown in FIG. 1, it is estimated that a 30 to 40dB null can be maintained when only mechanical tolerances are considered. Additional nulling, to 80 or 90dB, can be accomplished using an electronically implemented cancelling device (not shown), such device is being known in the art.

With respect to the antenna system of the invention, it is important to note that the null achieved is not a frequency domain null, but is a "spatial" null, obtained equally at all frequency components contained in the transmitter wire. Therefore, it is possible to space the transmitter and receiver frequencies closer than what could be obtained notch using filtering techniques as described above with respect to prior art systems.

It should be noted that in the construction of an antenna system as described, as a loop receiving antenna, such as "TM" loops 20 and 21, are brought closer into proximity with the transmitting antenna, the sensitivity to the alignment of the receiving loops with respect to the transmitting antenna becomes greater. This sensitivity need not be critical, however, since the signals produced in the loop antennas can be weighted or processed by known techniques, to elimiate the errors produced by such spatial misalignment. Generally, such error correction techniques employ means for sampling and weighting the output and comparing the sample to a reference signal, which can be derived, for instance by a reference loop antenna adjacent the transmitting antenna in a sense in which a maximum signal is developed in the reference loop. The compared signal constitutes an error signal which is then subtracted from the desired signal to obtain a corrected signal.

It should be noted, especially in the case of airborne long wire transmitting antennas, some spatial misalignment can be expected due to wind and other factors, making such electronic correction desireable in many cases. Such electronic signal processing or correction circuits are abundant in the art and are not described in detail herein.

Although the invention has been described and illustrated with a certain degree of particularity, it is understood that the present disclosure has been made by way of example only and that numerous changes in the combination and arrangement of parts may be resorted to by those skilled in the art without departing from the spirit and the scope of the invention as hereinafter claimed.

I claim:

1. A receiving antenna system for use in proximity to a transmitting antenna having a circular radiating magnetic field, comprising:

three receiving antennas, each having a null spatial sensitivity pattern along at least one axis thereof, each of said three antennas being oriented with said circular radiating antenna located in the null pattern thereof, whereby said three antennas are insensitive to signals from said circular radiating antenna and are sensitive to signals from a remote location.

2. The receiving antenna of claim 1 wherein said three antennas are each have their respective axes of null sensitivity mutually orthogonally oriented.

3. The receiving antenna of claim 2 wherein at least two of said three antennas are sensitive to "TM" waves from a remote location and at least one of said three antennas is sensitive to "TE" waves from a remote location.

4. The receiving antenna of claim 3 wherein said at least one antenna which is sensitive to "TE" waves is oriented with its axis of null spatial sensitivity parallel to said antenna having a circular radiating field.

5. The receiving antenna of claim 1, 2, 3 or 4 in which at least one of said receiving antennas is a loop antenna.

6. A receiving antenna system for use with an associated receiver, and for operation in proximity to a monopole transmitting antenna, comprising:

a plurality of receiving loops, each said loop having an imaginary line associated therewith piercing a central point of said loop and perpendicular to a plane containing said loop, and each loop being oriented so that its associated line lies in a plane containing said monopole antenna, whereby said monopole antenna is located in a null region of sensitivity of said loops.

7. The antenna of claim 6 wherein said plurality of loops comprises three loops.

8. The antenna of claim 7 wherein said three loops are oriented with the imaginary central lines being respectively parallel to the axes of an orthogonal coordinate system.

9. The antenna of claim 8 wherein one of the imaginary lines is aligned with the axis of the monopole antenna.

10. An antenna system comprising:

a transmitting antenna having a known radiating pattern, three receiving antennas, each having a region of spatial null sensitivity to the radiating pattern of said transmitting antenna, each of said three receiving antennas being oriented with respect to said transmitting antenna so that the known radiating pattern falls within the region of null sensitivity of each receiving antenna.

11. The antenna system of claim 10 wherein said transmitting antenna is a long wire antenna.

12. The antenna system of claim 11 wherein said long wire antenna is suspended from a balloon.

13. The antenna system of claim 11 wherein said long wire antenna is a VLF antenna.

14. The antenna system of claim 10, 11, 12 or 13 wherein at least one of said receiver antennas is a loop antenna, said loop antenna being oriented with an imaginary line perpendicular to a plane containing the loop and with said line passing through the transmitting antenna.

* * * * *